US005769205A

United States Patent [19]

Belvederi et al.

[11] Patent Number: 5,769,205

[45] Date of Patent: Jun. 23, 1998

[54] CONTINUOUS CIGARETTE MANUFACTURING MACHINE

[75] Inventors: Bruno Belvederi, S. Martino di Monte S. Pietro; Giulio Barbieri, Anzola Emilia, both of Italy

[73] Assignee: G. D Societa Per Azioni, Bologna, Italy

[21] Appl. No.: 541,909

[22] Filed: Oct. 10, 1995

[30] Foreign Application Priority Data

Oct. 13, 1994 [IT] Italy ..... B094A0448
Mar. 24, 1995 [IT] Italy ..... B095A0127

[51] Int. Cl.[6] ..... B65G 47/84

[52] U.S. Cl. ..... 198/475.1; 198/474.1

[58] Field of Search ..... 198/343.1, 343.2, 198/474.1, 475.1, 478.1

[56] References Cited

U.S. PATENT DOCUMENTS 2,007,981 7/1935 Nordquist ..... 198/478.1
2,320,650 6/1943 Popov .
3,010,561 11/1961 Ricke ..... 198/474.1 X
5,154,278 10/1992 Deutsch ..... 198/475.1
5,353,909 10/1994 Mukai et al. ..... 198/343.2

FOREIGN PATENT DOCUMENTS 0548972 6/1993 European Pat. Off. .
2905376 8/1980 Germany ..... 198/474.1
0241062 11/1986 Germany ..... 198/478.1
8805250 8/1988 Germany .

*Primary Examiner*—James R. Bidwell
*Attorney, Agent, or Firm*—Ladas & Parry

[57] ABSTRACT

A continuous cigarette manufacturing machine wherein an input feedbox presents at least two outputs located at a loading station and for successively feeding respective groups of cigarettes directly into respective folding spindles on a wrapping wheel rotating continuously about its axis; the spindles are divided into groups, each presenting a number of spindles equal to the number of outputs of the feedbox; and the spindles in each group are activated by respective actuating devices moving with the wrapping wheel, and presenting respective spindle supporting elements oscillating differently in relation to the wrapping wheel by virtue of respective cam devices.

28 Claims, 5 Drawing Sheets

24
3
6
5
P2
P
12
18
28
16
7
V
32
30
31
27
37
35
33
34
15
25
11
10
36
23
20
13
P1
17
2

24
6
5
P2
P
29
12
19
16
7
32
31
30
37
35
25
34
33
15
36
P1
27
23
VI
10
11
20
13
2
17

CONTINUOUS CIGARETTE MANUFACTURING MACHINE

BACKGROUND OF THE INVENTION

The present invention relates to a continuous cigarette manufacturing machine, in particular, a machine wherein a continuous conveyor member is supplied successively, at a loading station, with items defined at least partly by a number of cigarettes, and feeds the items along a given path along which they are variously manipulated.

For the sake of simplicity, in the following description, reference is made purely by way of example to a specific type of manufacturing machine comprising a packing machine, wherein the above conveyor member comprises a wrapping wheel, and the items manipulated comprise groups of cigarettes fed out of a feedbox and each ultimately forming the content of a respective packet.

Currently used cigarette manufacturing systems normally comprise one or more normally intermittent-operating packing machines, i.e. of the type wherein the cigarettes, supplied in bulk to the input feedbox of the packing machine, are withdrawn from the feedbox and fed in groups, normally comprising twenty cigarettes, to a step conveyor. This normally presents a succession of pockets which, as the conveyor moves forward in steps, are successively arrested at a loading station in front of the feedbox to receive a respective group of cigarettes. Once formed and loaded on to the step conveyor, the groups of cigarettes are fed to a manipulating and wrapping line along which they are fed in steps and subjected to a number of wrapping operations at a given number of stops between one step and the next.

Though highly efficient and reliable, intermittent packing machines of the above type obviously present a number of drawbacks typical of any intermittent mechanism, and which, mainly on account of the high operating speeds involved, result in severe vibration and hence a high noise level, and in relatively high maintenance costs.

To overcome the above drawbacks and, at the same time, permit even higher operating speeds, so-called "continuous" packing machines have for some time been devised, and numerous patents have been filed, including, for example, European Patents n. 210,544 and 435,087, and British Patent n. 1,497,221.

The above patents all relate to continuous packing machines, wherein an input feedbox with a number of outputs is connected to a continuous wrapping wheel, i.e. rotating at substantially constant angular speed about its axis, by an intermediate conveyor which receives groups of cigarettes at a loading station defined by the outputs of the feedbox, and transfers them successively to an unloading station where they are unloaded on to the wrapping wheel. The intermediate conveyor is either a step-feed type, as in the case of European Patent n. 435,087, or a combination-feed type, i.e. intermittent at the loading station and continuous at the unloading station.

The solution proposed in the above patents, however, is far from satisfactory. Firstly, on account of the presence of the intermediate conveyor which involves a considerable increase in the length of the packing line of the packing machine and the supporting frame; and secondly on account of the intermediate conveyors described all being connected to intermittent devices which compel the packing machines - otherwise continuous - to operate within the speeds typical of currently used intermittent machines.

SUMMARY OF THE INVENTION

It is an object of the present invention to provide a packing machine designed to overcome the aforementioned drawbacks.

More generally speaking, it is an object of the present invention to provide a continuous cigarette manufacturing machine, wherein a continuous conveying and manipulating member is supplied, by a feed device with a number of outputs, and with no need for an intermediate intermittent transfer device, with items defined at least partly by a number of cigarettes.

According to the present invention, there is provided a continuous cigarette manufacturing machine comprising a conveyor; a number of conveying units supported on the conveyor, and in turn respectively comprising a conveying pocket for receiving an item comprising a number of cigarettes, and supporting means for connecting the pocket to the conveyor, which is moved continuously to move the pockets successively along a given path, said supporting means moving in relation to the conveyor to move the respective pocket along said path and in relation to the conveyor; a loading station located along said path; and supply means for supplying said items, and presenting at least two outputs at the loading station; characterized in that said conveying units are divided into groups, each comprising a number of pockets equal to the number of outputs of said supply means; and said supporting means are provided with control means for imparting to the pockets of the conveying units in each said group given movements in relation to the conveyor.

According to a preferred embodiment of the above machine, said control means comprise cam means of the same number as the pockets in each group; each said cam means being associated with one pocket per each said group.

More specifically, each pocket in each said group is preferably associated, together with all the corresponding pockets in the other groups, with the same said cam means.

BRIEF DESCRIPTION OF THE DRAWINGS

Two non-limiting embodiments of the present invention will be described by way of example with reference to the accompanying drawings, in which.

DETAILED DESCRIPTION OF THE INVENTION

Figure 1:
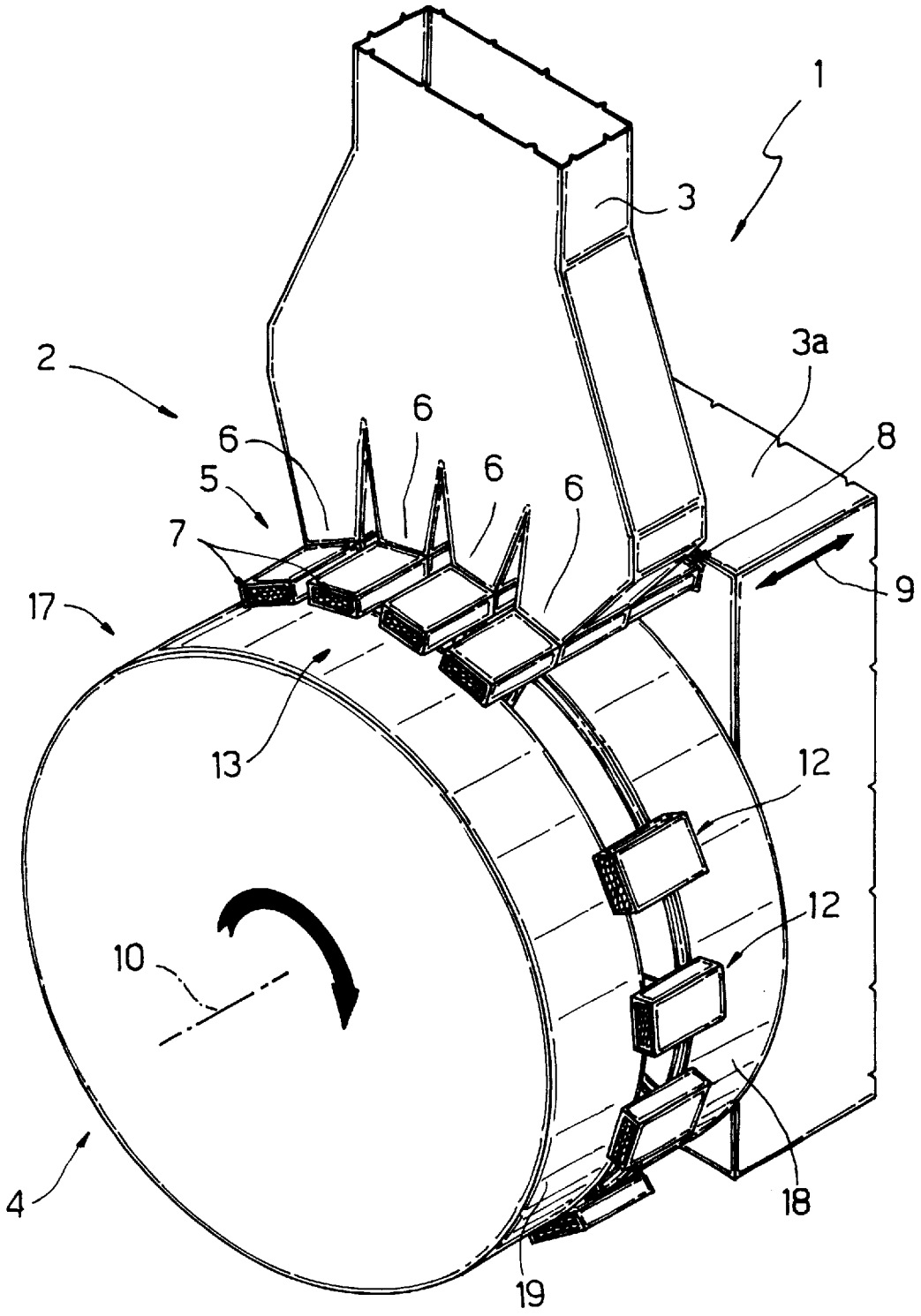
FIG. 1 shows a schematic view in perspective of a first preferred embodiment of the input portion of the packing machine according to the present invention.
Figure 2:
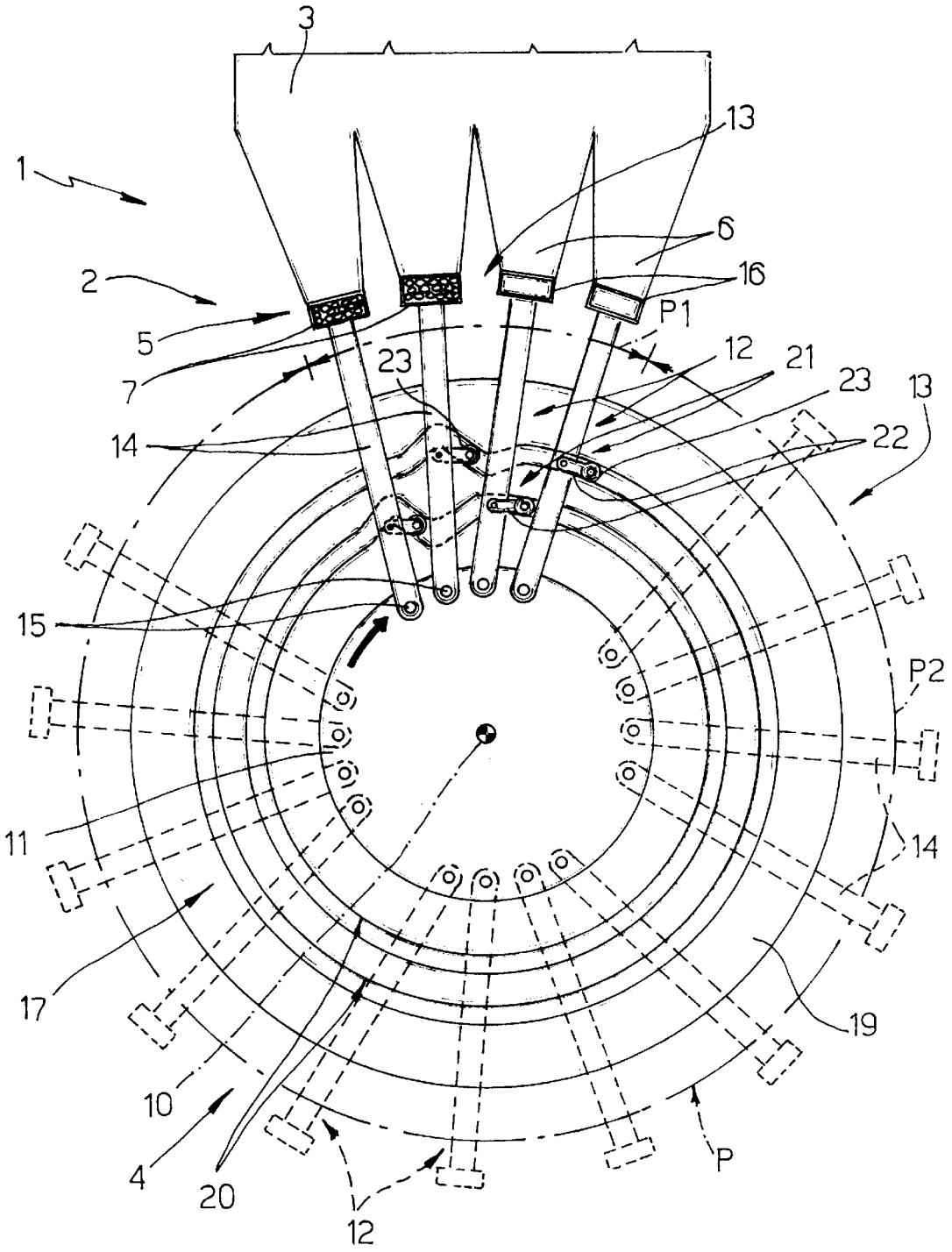
FIG. 2 shows a schematic cross section of the FIG. 1 portion of the packing machine.

Number 1 in FIGS. 1 and 2 indicates a cigarette manufacturing machine comprising, in the example shown, a continuous packing machine, the input portion 2 of which comprises a feedbox 3, a frame 3*a*, and a wrapping wheel 4 fitted to frame 3*a* and connected directly to feedbox 3 at a loading station 5.

In the example shown, feedbox 3 comprises four outputs 6 - which may be more than four but no fewer than two - for respective groups 7 of cigarettes ultimately forming the content of a packet (not shown). For each output 6, feedbox 3 also comprises a known extracting device 8 movable back and forth through output 6 and in direction 9 parallel to the axes of the cigarettes (not shown) inside feedbox 3, to successively feed groups 7 on to wheel 4 at station 5.

Wheel 4 rotates continuously about its axis 10 substantially parallel to direction 9, to feed groups 7 along a substantially circular path P comprising a loading arc P1 extending through station 5, and a wrapping and unloading arc P2 complementary to arc P1.

Wheel 4 comprises a central conveying drum 11 rotating clockwise (in FIG. 2) about axis 10 at a substantially constant angular speed; and a number of wrapping units 12 arranged about drum 11. Units 12 are formed into groups 13, each comprising a number of units 12 equal to the number of outputs 6; and each unit 12 comprises an oscillating arm 14 extending substantially radially from drum 11, and pivoting at one end about a respective pin 15 parallel to axis 10 and connected integral with drum 11. At the opposite end to that connected to respective pin 15, each arm 14 is fitted integral with a conveying pocket for housing a respective group 7, and comprising a tubular folding spindle 16 extending parallel to axis 10 and for receiving a respective group 7 extracted in known manner from an output 6 by respective extracting device 8.

Wheel 4 presents a control device 17 comprising two opposed, angularly-fixed disks 18 and 19 on either side of and coaxial with drum 11. As shown in FIG. 2, on the side facing drum 11, disks 18 and 19 present a given number of respective annular cam grooves 20 extending about axis 10 (only grooves 20 of disk 19 are shown). More specifically, the total number of grooves 20 on both disks 18 and 19 equals the number of outputs 6 and of spindles 16 in each group 13. That is, as each group 13 in the example shown presents four spindles 16, each disk 18, 19 presents two grooves 20. Each groove 20 controls the angular position, in relation to drum 11, of a respective arm 14 in each group 13 via respective actuating devices comprising tappet devices 21, which form part of device 17 and each comprise a respective lever 22 extending transversely from a respective arm 14 and fitted on its free end with a tappet roller 23 engaged in rolling manner inside groove 20.

Consequently, each groove 20 is engaged by a number of rollers 23 equal to the number of groups 13, and imparts the same movement to each roller 23; which movement provides for so oscillating respective arm 14 in relation to drum 11 that, as respective spindle 16 travels along arc P1, arm 14 first rotates about its pin 15 in the same direction as drum 11 so as to rotate about axis 10 at a greater angular speed than drum 11, and then, by virtue of the shape of respective groove 20, is arrested in relation to drum 11 and begins reversing, in relation to drum 11, at a gradually increasing angular speed until it reaches the same speed as drum 11.

Grooves 20 are identical, but each is so offset in relation to the others that each arm 14 is brought into the above condition simultaneously with the other arms 14 in the same group 13, in which condition, the respective spindle 16 is arrested in space when positioned substantially coaxial with respective output 6 in station 5.

In other words, at least along a central portion of arc P1, grooves 20 are so formed that spindles 16 in the same group 13 present the same spacing as outputs 6 when they are simultaneously arrested coaxial with respective outputs 6 for a given hold time, which time is exploited by extracting device 8 to insert a respective group 7 inside each spindle 16 arrested in front of a respective output 6.

In connection with the above, it should be pointed out that each spindle 16 may be arrested at any point along arc P1 by simply altering the shape of grooves 20, so that, even if outputs 6 are not equally spaced by spacing S1 along arc P1, as shown in FIG. 2, grooves 20 may be so formed as to simultaneously arrest spindles 16 in the same group 13 in front of respective outputs 6.

As shown in FIG. 2, outside arc P1 and at least along a central portion of wrapping and unloading arc P2, grooves 20 are so formed as to space spindles 16 in any required manner, depending on the spacing, along arc P2, of the devices (not shown) cooperating with spindles 16 to perform a given number of manipulating and folding operations. In the specific example shown, grooves 20 are so formed as to impart a substantially equal spacing S2 to all of spindles 16, regardless of which group 13 they belong to, to enable a succession of known wrapping operations to be performed on each spindle 16 by known folding and gumming devices (not shown) located along arc P2.

In other words, device 17 acts as a group forming device for forming groups 13 by manipulating a continuous succession of spindles 16 with a given spacing (in the example shown, equally spaced with spacing S2 along at least part of arc P2 and travelling along arc P2 at substantially constant angular speed) to divide the continuous succession into a succession of groups 13 as spindles 16 travel along arc P1. Moreover, device 17 also acts as a pitch change device by imparting different movements to spindles 16 in each group 13 along arc P1, and such that the spindles 16 in the same group 13 present the same spacing as outputs 6 at station 5, and are arrested simultaneously, and for the same hold time, in front of outputs 6.

In connection with the above, it should be pointed out that, though subordinate in relation to the possibility of eliminating an intermediate conveyor between wrapping wheel 4 and outputs 6 of feedbox 3, the above pitch variation is to be considered, to all intents and purposes, a secondary object of the present invention. In fact, the possibility of varying the spacing of spindles 16 enables them to be positioned relatively far apart along arc P2, to permit the assembly and correct operation, along arc P2, of any manipulating devices (not shown), and also enables the spindles 16 in each group 13 to be positioned relatively close together along arc P1, to permit similar close positioning of outputs 6 and the use of relatively compact feedboxes 3 wherein outputs 6 present substantially the same slope and, hence, provide for substantially the same fall pattern of the cigarettes.

Figure 3:
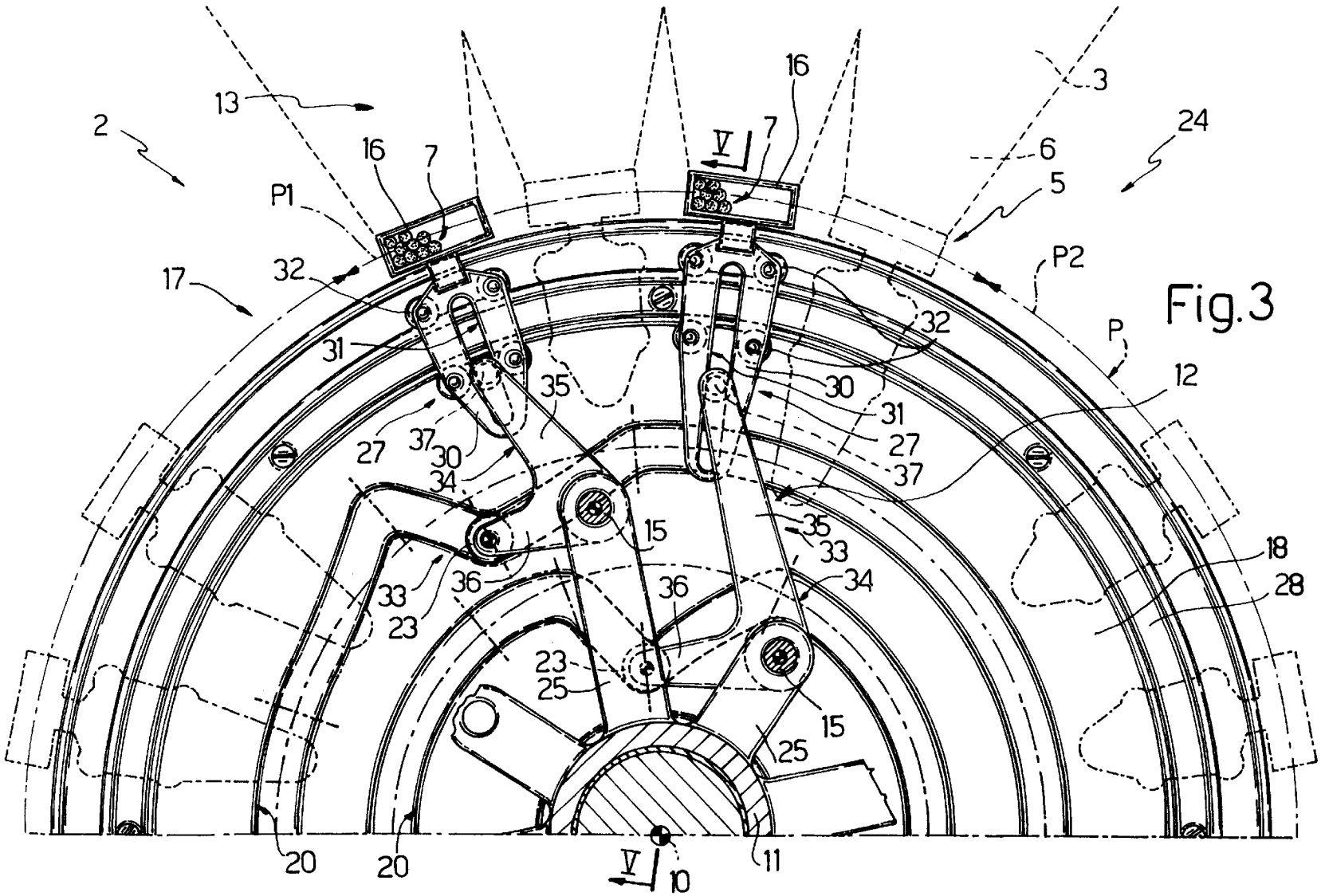
FIGS. 3 and 4 show two cross section details of a second preferred embodiment of the FIG. 1 input portion of the packing machine according to the present invention.
Figure 4:
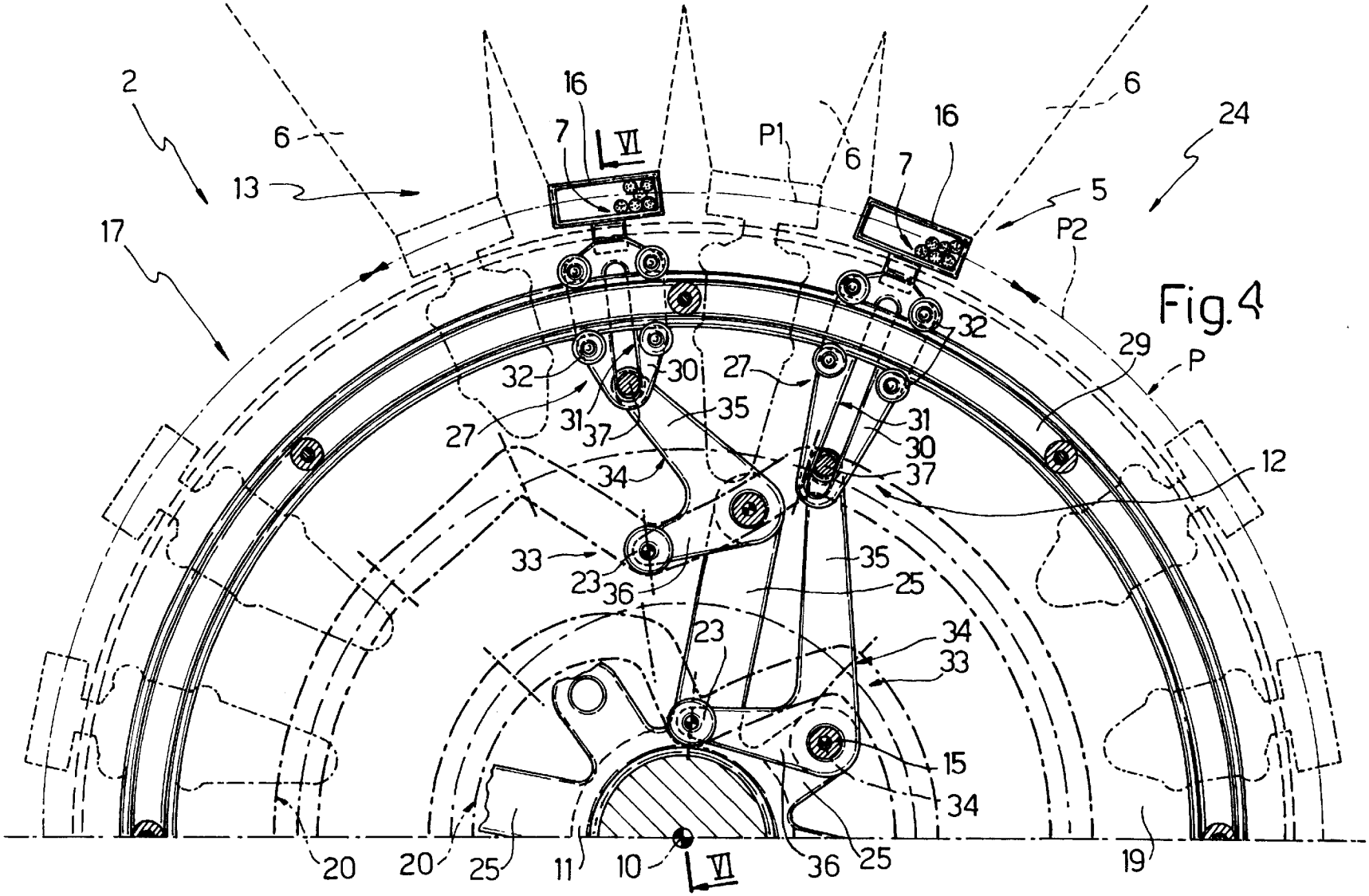

The FIGS. 3 and 4 embodiment relates to a wrapping wheel 24 similar to wheel 4, except that units 12, as opposed to pivoting directly on drum 11, pivot on respective radial arms 25 extending integrally from drum 11 in the gap between disks 18 and 19, arranged in two rows 26 facing each other and a respective disk 18, 19, and presenting two different lengths alternating with each other.

Also, units 12 no longer present oscillating arms 14 which are replaced by carriages 27 for supporting respective spindles 16 and running along two annular guide rails 28, 29 coaxial with axis 10. Rails 28, 29 are supported on respective disks 18, 19, extend along path P in the gap between disks 18 and 19, and each support half of the spindles 16 in each group 13, i.e. two spindles 16, for the reasons explained previously. More specifically, the spindles 16 in each group 13 supported on rail 28, 29 alternate with the spindles 16 in the same group 13 supported on rail 29, 28. Each carriage 27 comprises a plate 30 crosswise to axis 10 and presenting a radial slot 31; and four wheels 32 mounted in pairs on either side of rail 28, 29.

The angular position of each unit 12 is controlled by grooves 20 via the interposition of respective actuating devices, each comprising a tappet device 33 substantially similar to device 21 of wheel 4, except that it comprises a square rocker arm 34, the intermediate portion of which pivots on and is oscillated about pin 15 fitted through the free end of arm 25. Each rocker arm 34 comprises two substantially perpendicular arms 35, 36; arm 35 presents an end portion connected in sliding manner by a pin 37 inside respective slot 31, and defines, together with respective plate 30, a crank and slotted link device; and arm 36 is fitted on its free end with tappet roller 23 engaged in rolling manner inside respective groove 20, as described previously.

On account of the different alternating lengths of arms 25, and the fact that the spindles 16 in each group 13 supported on the same rail 28, 29 are connected by respective rocker arms 34 to two adjacent arms 25, the radial lengths of slots 31 and hence of respective plates 30 and respective arms 35 also differ.

Figure 5:
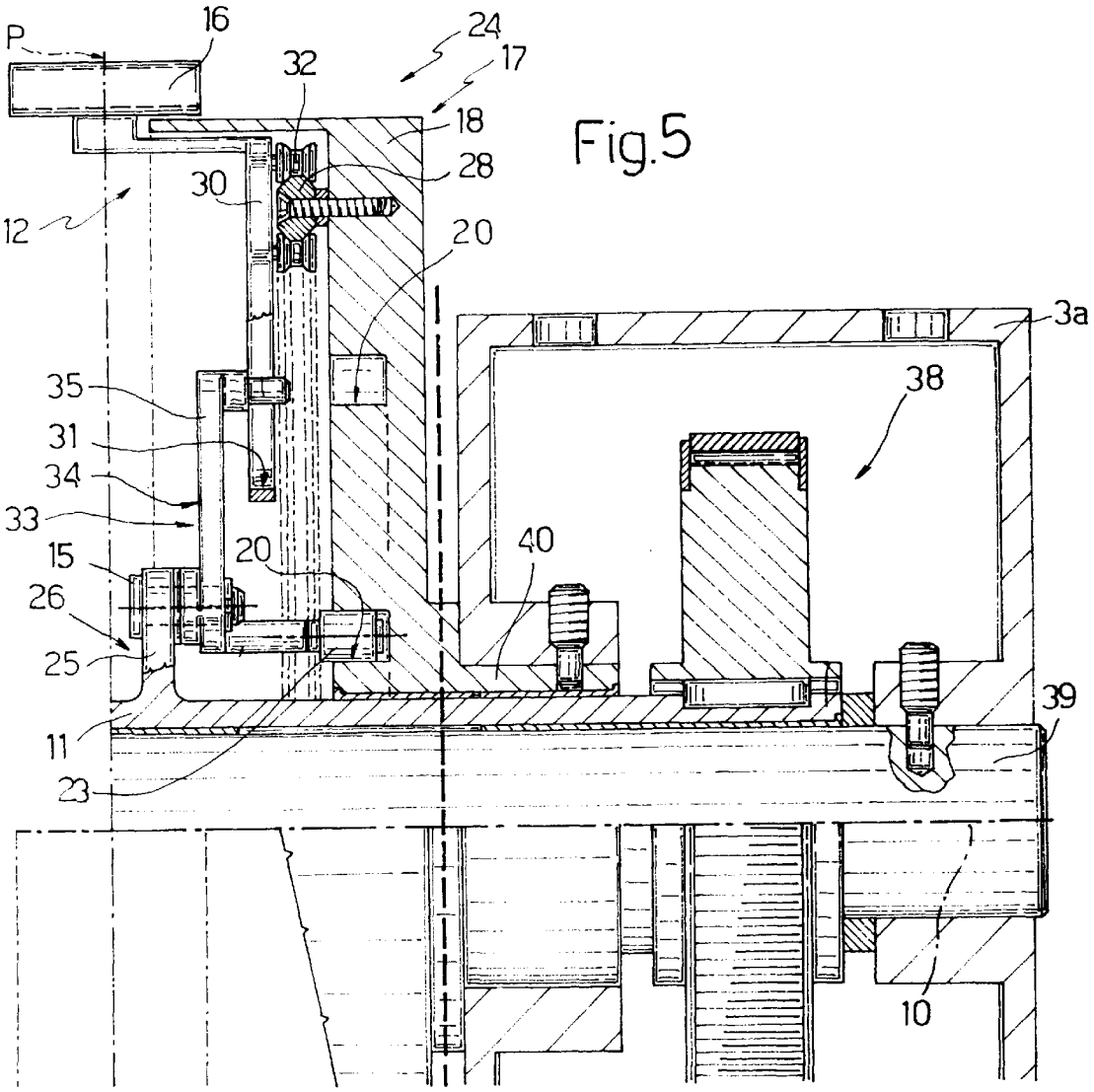
FIG. 5 shows a section along line V—V in FIG. 3.
Figure 6:
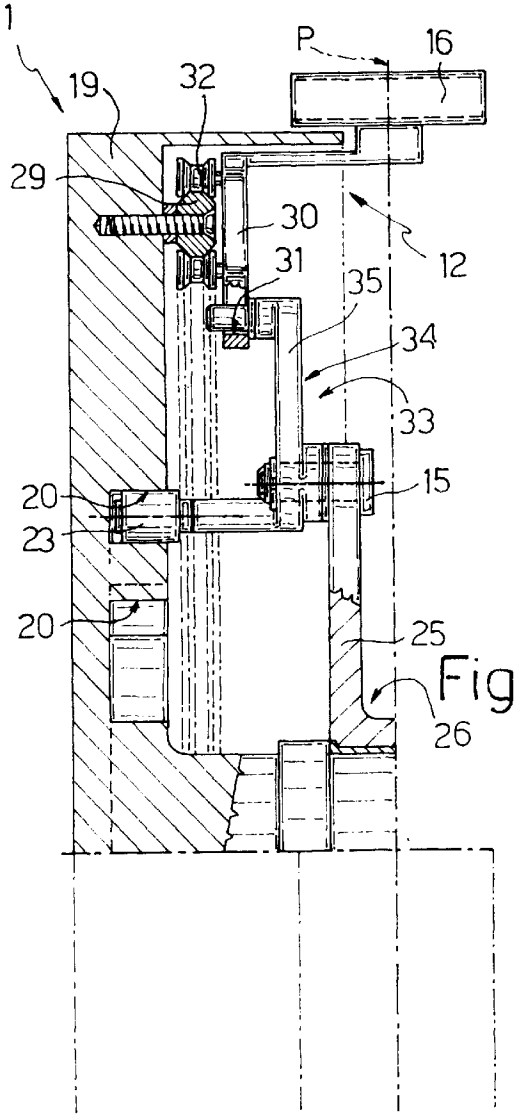
FIG. 6 shows a section along line VI—VI in FIG. 4.

As shown in FIGS. 5 and 6, drum 11 is rotated (clockwise in FIGS. 3 and 4) about axis 10 at substantially constant angular speed by a known belt drive 38 housed inside frame 3*a,* and is fitted through centrally by a supporting shaft 39 extending transversely from frame 3*a* and fitted on its free end with disk 19. Disk 18 is fitted through centrally with drum 11 and hence shaft 39, and presents, on the opposite side to that facing disk 19, a tubular element for fitment to frame 3*a*.

Wheel 24 operates in the same way as wheel 4, and observations made previously in connection with wheel 4 also apply to wheel 24.

We claim:

1. A continuous cigarette manufacturing machine comprising a conveyor; a number of conveying units supported on the conveyor, and in turn respectively comprising a conveying pocket for receiving an item comprising a number of cigarettes, and supporting means for connecting the pocket to the conveyor, said conveyor being movable continuously to move the pockets successively along a given path, said supporting means being movable in relation to the conveyor to move the respective pocket along said path and in relation to the conveyor; a loading station located along said path; and supply means for supplying said items, and having at least two outputs at the loading station; said conveying units being divided into groups, each comprising a number of pockets equal to the number of outputs of said supply means; said supporting means being provided with control means for imparting to the pockets of the conveying units in each said group given movements in relation to the conveyor, said control means comprising a plurality of cam means equal in number to the pockets in each group; each said cam means being associated with one pocket in each said group; each pocket in each said group being associated, together with all the corresponding pockets in the other groups, with the same cam means of said plurality of cam means; said cam means differing from each other to impart different movements to the associated pockets in each group, and being so formed as to impart a backward movement to each associated pocket at said loading station, so as to arrest each said pocket for a given time period.

2. A machine as claimed in claim 1, wherein said cam means are so formed as to simultaneously arrest all the pockets in each said group at respective said outputs.

3. A machine as claimed in claim 1, wherein said cam means are so formed as to space said pockets substantially equally along a portion of said path outside said loading station.

4. A machine as claimed in claim 3, wherein said conveyor comprises a drum rotatable about an axis; said cam means extending annularly about said axis.

5. A machine as claimed in claim 1, wherein said machine is a cigarette packing machine; said supply means comprising an input feedbox for supplying cigarettes; and each said item comprising a group of cigarettes placed together to form the contents of a packet of cigarettes.

6. A machine as claimed in claim 5, wherein each said pocket comprises a tubular folding spindle (16) for receiving a respective said group of cigarettes.

7. A machine as claimed in claim 6, wherein said conveyor comprises a drum rotatable about an axis said spindles being positioned parallel to said axis and crosswise to said path.

8. A continuous cigarette manufacturing machine comprising a conveyor; a number of conveying pockets for receiving an item comprising a number of cigarettes, a conveyor for moving said pockets along a path; a loading station located along said path; and supply means for supplying said items to said pockets, said supply means having at least two outputs located at said loading station; said pockets being divided into groups, each including a number of said pockets equal to the number of outputs of said supply means; and control means interposed between each said pocket and the conveyor to impart to the associated said pocket a respective movement along said path in relation to the conveyor; said control means being constructed so that the movement of each said pocket is different from that of the other pockets of the same group, but is identical to the movement of the corresponding pockets of the other groups.

9. A machine as claimed in claim 8, wherein said control means comprises a plurality of cam means, which are equal in number to the pockets in each group; each said cam means being associated with a respective pocket in each said group.

10. A machine as claimed in claim 9, wherein each pocket in each said group is associated, together with all the corresponding pockets in the other groups, with the same said cam means.

11. A machine as claimed in claim 10, wherein each said cam means differs from each of the other of said cam means to impart different movements to the pockets in each group.

12. A continuous cigarette manufacturing machine comprising a conveyor device in turn comprising a number of conveying pockets for receiving respective items defined at least partly by a number of cigarettes; first activating means for imparting to each said pocket a continuous, substantially constant first movement along a given path; and second activating means for imparting to each said pocket a reciprocating second movement for arresting the pocket for a given time period at a respective given stop point along said path; said second activating means comprising control means for dividing said number of pockets into a number of groups each having the same predetermined number of pockets; said control means comprising a number of cams equal to said predetermined number of pockets; each cam controlling the position of one said rocket in each said group; said cams defining different respective said stop points and actuating means associated with the control means, for varying, along said path, the spacing both of said groups in relation to one another, and of the pockets in each group in relation to one another.

13. A machine as claimed in claim 12, wherein the pockets in each group are positioned adjacent and consecutive to one another along said path.

14. A machine as claimed in claim 12, wherein said cams are so timed in relation to one another as to simultaneously arrest all the pockets in the same group at the respective said stop points.

15. A machine as claimed in claim 12, which further comprises a loading station at which to load said items inside respective said pockets; and supply means for feeding said items to the loading station; said supply means having a number of outputs equal to said predetermined number; and each said output being located at a respective said stop point along said path.

16. A machine as claimed in claim 15, wherein said supply means comprises a feedbox for supplying cigarettes.

17. A machine as claimed in claim 15, wherein said cams are so formed as to impart to the pockets in each group a first spacing at the loading station, and a second spacing, differing from the first spacing, along a portion (P) of said path (P) outside the loading station.

18. A machine as claimed in claim 17, wherein said first spacing coincides with the spacing of said stop points along said path.

19. A machine as claimed in claim 17, wherein said second spacing is an equal spacing common to the pockets in all said groups along said path portion outside the loading station, so as to substantially equally space said pockets along the portion of said path outside the loading station.

20. A machine as claimed in claim 12, wherein said conveyor device (4) (24) comprises a wrapping wheel; each said pocket comprising a wrapping spindle.

21. A machine as claimed in claim 20, wherein said first activating means comprises a drum rotatable about an axis (10); said cam means being annular and extending about said axis (10).

22. A machine as claimed in claim 21, wherein said wrapping wheel comprises at least two guide elements, each common to at least half of said given number of said spindles; said two guide elements being defined by respective annular rails extending about said axis.

23. A machine as claimed in claim 22, wherein said conveying units comprise supporting means for connecting said spindles (16) to the rails; each said supporting means comprising a respective carriage defined by a plate integral with the respective spindle, and by at least two wheels supported for rotation on the plate and engaged in rolling manner by said rails.

24. A machine as claimed in claim 23, wherein, for each said spindle, said second activating means comprises a rocker arm connected in rotary manner to the drum, and in sliding manner to the respective plate.

25. A continuous cigarette manufacturing machine comprising a conveyor; a number of conveying units supported on the conveyor, and in turn respectively comprising a conveying pocket for receiving an item comprising a number of cigarettes, and supporting means for connecting said pocket to the conveyor, said conveyor being movable in a continuous manner to move the pockets successively along a given path, said supporting means being movable in relation to the conveyor to move the respective pocket along said path and in relation to the conveyor; a loading station located along said path; and supply means for supplying said items, and having at least two outputs at the loading station; said conveying units being divided into groups, each comprising a number of pockets equal to the number of outputs of said supply means; said supporting means being provided with control means for imparting to the pockets of the conveying units in each said group given movements in relation to the conveyor; said control means being constructed to impart a backward movement to each associated pocket at said loading station, so as to arrest each said pocket for a given time period at a respective said output.

26. A machine as claimed in claim 25, wherein said control means comprises cam means of the same number as the pockets in each group; each said cam means being associated with one pocket in each said group.

27. A machine as claimed in claim 26, wherein each pocket in each said group is associated, together with all the corresponding pockets in the other groups, with the same said cam means.

28. A machine as claimed in claim 27, wherein said cam means differ from each other to impart different movements of the pockets in each group.

* * * * *